US007932879B2

(12) United States Patent
Bergfors et al.

(10) Patent No.: US 7,932,879 B2
(45) Date of Patent: Apr. 26, 2011

(54) CONTROLLING ELECTROLUMINESCENT PANELS IN RESPONSE TO CUMULATIVE UTILIZATION

(75) Inventors: Kristian Bergfors, Lund (SE); Anders Larsson, Torna Hallestad (SE); Mats Kleverman, Helsingborg (SE)

(73) Assignee: Sony Ericsson Mobile Communications AB, Lund (SE)

( * ) Notice: Subject to any disclaimer, the term of this patent is extended or adjusted under 35 U.S.C. 154(b) by 1022 days.

(21) Appl. No.: 11/800,927

(22) Filed: May 8, 2007

(65) Prior Publication Data

US 2008/0278099 A1 Nov. 13, 2008

(51) Int. Cl.
*G09G 3/36* (2006.01)

(52) U.S. Cl. ..... 345/76; 345/77

(58) Field of Classification Search ..... 345/87–102, 345/204, 76–82

See application file for complete search history.

(56) References Cited

U.S. PATENT DOCUMENTS

| | | | | |
|---|---|---|---|---|
| 4,975,692 | A | 12/1990 | Tateyama | |
| 5,493,183 | A | 2/1996 | Kimball | |
| 6,353,291 | B1 | 3/2002 | Borgogno et al. | |
| 2003/0214467 | A1 | 11/2003 | Koyama et al. | |
| 2004/0207609 | A1 * | 10/2004 | Hata et al. | 345/204 |
| 2005/0259090 | A1 * | 11/2005 | Wang et al. | 345/204 |
| 2006/0071900 | A1 | 4/2006 | Drader et al. | |
| 2006/0192749 | A1 | 8/2006 | Lowles et al. | |
| 2006/0221015 | A1 * | 10/2006 | Shirasaki et al. | 345/77 |
| 2006/0250339 | A1 * | 11/2006 | Kim | 345/87 |
| 2007/0030222 | A1 * | 2/2007 | Lee et al. | 345/87 |
| 2007/0035538 | A1 * | 2/2007 | Garcia et al. | 345/212 |
| 2007/0070026 | A1 * | 3/2007 | Cho et al. | 345/102 |
| 2007/0242068 | A1 * | 10/2007 | Han et al. | 345/427 |
| 2007/0247415 | A1 * | 10/2007 | Yasunaga | 345/102 |
| 2008/0117153 | A1 * | 5/2008 | Fujine et al. | 345/89 |
| 2009/0051637 | A1 * | 2/2009 | Chen et al. | 345/88 |
| 2009/0225065 | A1 * | 9/2009 | Overes | 345/207 |
| 2010/0013795 | A1 * | 1/2010 | Okino | 345/175 |
| 2010/0060620 | A1 * | 3/2010 | Yamazaki et al. | 345/207 |

FOREIGN PATENT DOCUMENTS

| | | | |
|---|---|---|---|
| DE | 101 60 667 | A1 | 6/2003 |
| WO | WO 00/41378 | A1 | 7/2000 |

OTHER PUBLICATIONS

Notification of Transmittal of the International Search Report and the Written Opinion of the International Searching Authority, or the Declaration, International Search Report, and Written Opinion of the International Searching Authority, PCT Application No. PCT/EP2007/061882, Feb. 21, 2008.

* cited by examiner

*Primary Examiner* — Nitin Patel

(74) *Attorney, Agent, or Firm* — Myers Bigel Sibley & Sajovec, P.A.

(57) ABSTRACT

An electronic device includes a light source, which generates light in response to a signal, and a controller. Because the luminosity of the light source decays over time, the controller generates a utilization value based on a cumulative time that the light source is emitting light, and regulates the signal that is provided to the light source in response to the utilization value to at least partially compensate for decay in the luminosity of the light source.

12 Claims, 4 Drawing Sheets

CONTROLLING ELECTROLUMINESCENT PANELS IN RESPONSE TO CUMULATIVE UTILIZATION

FIELD OF THE INVENTION

This invention relates to illumination in electronic devices, and more particularly to illumination of displays and/or keypads for electronic devices such as wireless communication terminals.

BACKGROUND OF THE INVENTION

Electronic devices such as wireless communications terminals typically include a display and a keypad which function as a user interface. Electronic devices often are used in poorly lit or dark environments, so that it may be desirable to illuminate the displays and keypads thereof. Illuminating such displays and keypads may present technical challenges for wireless communications terminals, and many other types of electronic devices, due to the desirability of decreasing the size and decreasing the power consumption of the wireless communications terminals, while at the same time providing bright, evenly distributed illumination.

Some electronic devices utilize Light Emitting Diodes (LEDs) and a lightguide to provide backlight illumination of displays/keypads. The LEDs emit light into a transparent material lightguide which guides the light until it meets surfaces that are designed to reflect light up through the display/keypad. Some lightguides are made of a dispersing (translucent) material, so that light is more uniformly scattered and emitted through the display/keypad. Unfortunately, lightguides may have low optical efficiency due to the desire to make the lightguide thin and/or the desire to provide holes and/or other deformations therein to accommodate other components of the electronic device. Moreover, since LEDs may send out light in many directions, efficient optical coupling to the lightguide may be difficult. It may also be difficult to obtain evenly distributed light from a lightguide so that about the same luminescence is provided across a coupled display/keypad.

Some electronic devices use electroluminescent panels to provide backlight illumination of displays/keypads. Electroluminescent panels may be formed as thin flexible sheets that may more uniformly illuminate a coupled display/keypad than may be provided by LED and lightguide configurations.

SUMMARY OF THE INVENTION

In some embodiments of the present invention, an electronic device includes a light source, which generates light in response to a signal, and a controller. Because the luminosity of the light source decays over time, the controller is configured to generate a utilization value based on a cumulative time that the light source has emitting light, and is further configured to regulate the signal provided to the light source in response to the utilization value and to at least partially compensate for decay in the luminosity of the light source.

In some further embodiments, the light source may include an electroluminescent panel that generates light in response to a power signal. The controller generates the utilization value based on the cumulative time that the electroluminescent panel has emitting light, and regulates the power signal provided to the electroluminescent panel in response to the utilization value and to at least partially compensate for decay in the luminosity of the electroluminescent panel.

The controller may increase amplitude of the power signal provided to the electroluminescent panel based on an increased utilization value indicating an increased cumulative time that the electroluminescent panel has emitting light. The controller may periodically increase amplitude of the power signal provided to the electroluminescent panel by one or more defined incremental amounts in response to the utilization value indicating that the cumulative time that the electroluminescent panel has emitting light exceeds a sequence of increasing threshold values. The controller may monitor amplitude of the power signal provided to the electroluminescent panel over periods of time, and regulate the incremental amount by which it periodically increases the amplitude of the power signal in response to the amplitude of the power signal provided to the electroluminescent panel.

In some further embodiments, the controller varies frequency of the power signal provided to the electroluminescent panel to increase luminosity therefrom based on an increased utilization value indicating an increased cumulative time that the electroluminescent panel has emitting light.

In some further embodiments, the controller monitors amplitude of the signal provided to the light source and generates the utilization value in response to the cumulative time that the light source has emitted light and the associated amplitude of the signal. The controller may generate the utilization value based on scaling a time duration, when the signal is provided to the light source to cause illumination therefrom, by the associated amplitude of the signal. The controller may repetitively increment a counter value while the signal is provided to the light source to cause illumination therefrom, vary the amount that the counter value is incremented based on amplitude of the signal, and generate the utilization value based on the counter value.

In some further embodiments, the electronic device includes an ambient light sensor that generates an ambient light signal. The controller turns-off the light source and, correspondingly, stops increasing the utilization value when the ambient light signal exceeds a threshold value.

In some further embodiments, the electronic device includes a cellular transceiver that is configured to communicate via at least one cellular wireless communication protocol over a wireless air interface. The controller temporarily increases the amplitude of the signal provided to the light source from a first level, providing a first luminosity level therefrom, to a higher second level, providing a higher second luminosity level therefrom, in response to a user initiating a cellular phone call and/or data messaging therefrom. The controller may repetitively increment a counter value while the signal is provided to the light source, increase the incremental amount that the counter value is repetitively incremented while the signal is at the second level relative to the incremental amount that the counter value is repetitively incremented while the signal is at the lower first level, and generate the utilization value based on the counter value.

In some further embodiments, the electronic device includes a liquid crystal display (LCD). The light source includes an electroluminescent panel that generates light in response to a power signal and is configured as a backlight to the LCD. The controller displays indicia on the LCD, generates the utilization value based on the cumulative time that the electroluminescent panel has backlit the LCD, and regulates the power signal provided to the electroluminescent panel in response to the utilization value so as at least partially compensate for decay in the luminosity of the electroluminescent panel.

In some further embodiments, the electronic device includes a keypad. The light source includes an electroluminescent panel that generates light in response to a power signal and is configured as a backlight to the keypad. The controller initiates a cellular phone call and/or generates a data message in response to user actuation of the keypad, generates the utilization value based on the cumulative time that the electroluminescent panel has backlit the keypad, and regulates the power signal provided to the electroluminescent panel in response to the utilization value to at least partially compensate for decay in the luminosity of the electroluminescent panel.

Some other embodiments are directed to a method that includes generating a utilization value based on a cumulative time that a light source has emitting light, and regulating a signal, which is provided to the light source to generate light, in response to the utilization value so as to at least partially compensate for decay in luminosity of the light source.

Some other embodiments are directed to a wireless communication terminal that includes a plurality of electronic components in the housing that are configured to transmit and/or receive wireless communications according to one or more wireless communication protocols, an electroluminescent panel, and a controller. The electroluminescent panel generates light in response to a power signal, and is configured to provide backlight to display and/or the keypad. Luminosity of the electroluminescent panel decays over time. The controller generates a utilization value based on a cumulative time that the electroluminescent panel has emitting light, and regulates the power signal provided to the electroluminescent panel in response to the utilization value to at least partially compensate for decay in the luminosity of the electroluminescent panel.

DETAILED DESCRIPTION OF PREFERRED EMBODIMENTS

Figure 1:
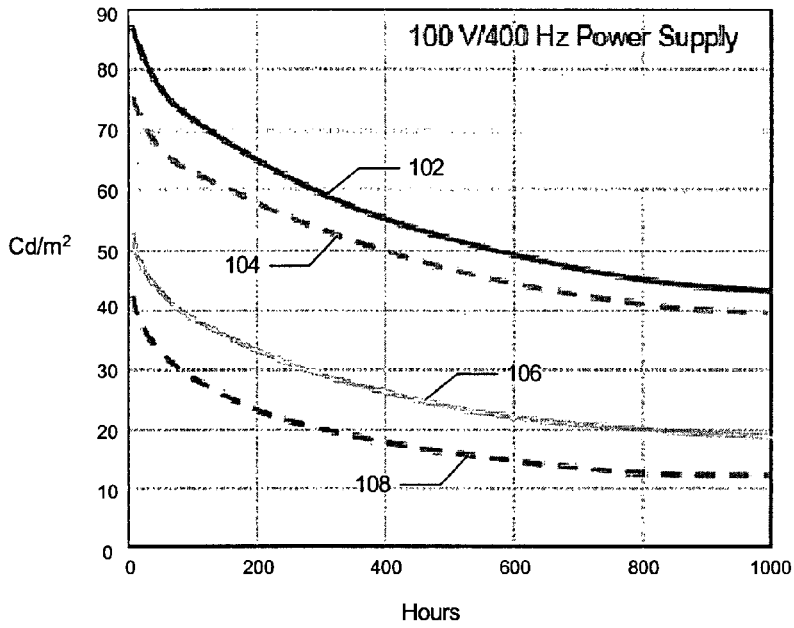
FIG. 1 is a graph that illustrates an exemplary change in luminescence over a cumulative time of use of four types of electroluminescent panels.

While the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention as defined by the claims. Like reference numbers signify like elements throughout the description of the figures.

As used herein, the singular forms "a," "an," and "the" are intended to include the plural forms as well, unless expressly stated otherwise. It should be further understood that the terms "comprises" and/or "comprising" when used in this specification is taken to specify the presence of stated features, integers, steps, operations, elements, and/or components, but does not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" and its abbreviation "/", include any and all combinations of one or more of the associated listed items.

The present invention is described below with reference to block diagrams and/or operational illustrations of apparatus, methods, and computer program products according to embodiments. It is to be understood that the functions/acts noted in the blocks may occur out of the order noted in the operational illustrations. For example, two blocks shown in succession may in fact be executed substantially concurrently or the blocks may sometimes be executed in the reverse order, depending upon the functionality/acts involved.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As described above, some electronic devices use one or more electroluminescent panels to backlight displays, keypads, and/or other user interfaces. Electroluminescent panels are well known to those having skill in the art. An electroluminescent panel emits light in response to a sufficient electric current passing through it and/or in response to a sufficient electric field. Example materials which may be used in electroluminescent panels include zinc sulfide doped with copper silver, group III-V semiconductors (e.g., InP, GaAs, and GaN), and organic semiconductors.

The luminescence, or intensity of light emitted, from electroluminescent panels may degrade over time. For example, some electroluminescent panels may exhibit a 50 percent reduction in luminosity within 300 hours of cumulative use. Moreover, some electroluminescent panels may exhibit an exponential degradation in luminosity over time. FIG. 1 is a graph that illustrates an exemplary change in luminescence over a cumulative time of use of four types of electroluminescent panels: 1) a green electroluminescent panel (curve 102), 2) a blue-green electroluminescent panel (curve 104), 3) a sky blue electroluminescent panel (curve 106), and 4) a deep blue electroluminescent panel (curve 108). Such luminosity degradation may become readily apparent when a user compares a used and new electronic device, and may misinterpret such degradation as forewarning of device failure or may otherwise deem such degradation to be unacceptable.

Figure 2:
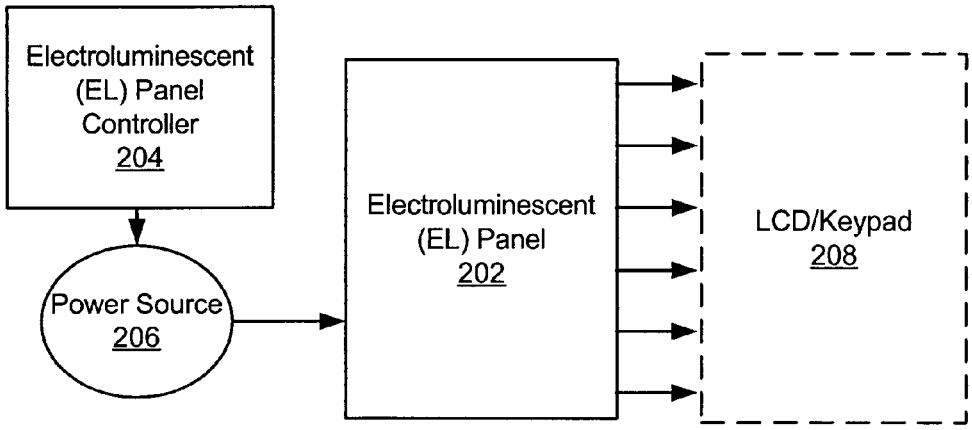
FIG. 2 is a block diagram of an electroluminescent panel and controller thereof that are configured in accordance with some embodiments of the present invention.

In accordance with some embodiments of the present invention, a controller regulates the power signal that is provided to an electroluminescent panel based on the cumulative use of the panel, and may thereby compensate for degradation of the luminosity of the panel. In accordance with some further embodiments, the controller regulates the power signal provided to the electroluminescent panel based on temperature of the panel over time. FIG. 2 is a block diagram of a electroluminescent panel 202, a controller 204, and a power source 206 that are configured in accordance with some embodiments of the present invention. The controller 204 generates a utilization value that indicates a cumulative time that the electroluminescent panel 202 has emitted light, and regulates a power signal that is provided by the power source 206 to the electroluminescent panel 202 in response to the utilization value. The controller 204 may increase the amplitude and/or change the frequency of the power signal that is provided to the electroluminescent panel 202 so as to compensate for degradation over time of the panel's luminosity. The electroluminescent panel 202 panel may, as shown, be used a backlight for a user interface 206, such as for a liquid crystal display (LCD) and/or for a keypad.

Figure 3:
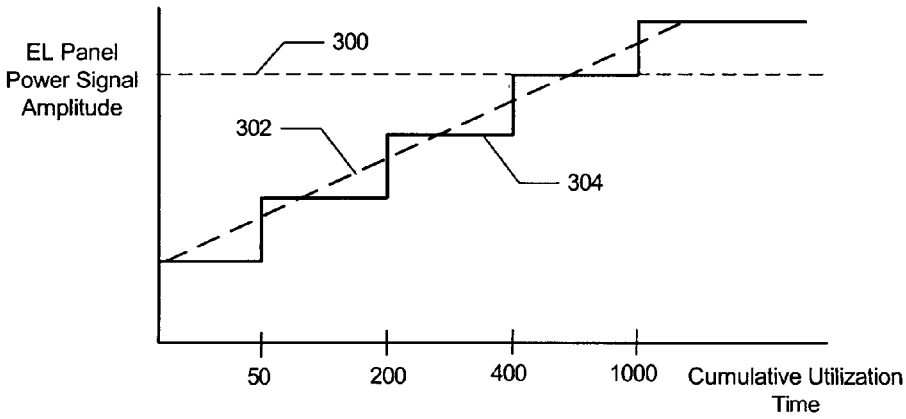
FIG. 3 is a graph that illustrates various operations and methods for regulating the amplitude of a power signal provided to the electroluminescent panel of FIG. 2 in response to a cumulative amount of time that the electroluminescent panel is powered-on in accordance with some embodiments of the present invention.

FIG. 3 is a graph that illustrates various operations and methods for regulating the amplitude of the power signal provided to the electroluminescent panel 202 in FIG. 2 in response to a cumulative amount of time that the electroluminescent panel 202 has emitted light. Referring to FIGS. 2 and 3, when the electroluminescent panel 202 is initially used, and for a defined cumulative time thereafter (e.g., 50 hours), the controller 204 controls the power source 206 to provide a defined power signal amplitude (e.g., 25% of a nominal level such as at line 300) to the electroluminescent panel 202. In response to the cumulative use of the electroluminescent panel 200 to reaching a first threshold (e.g., 50 hours), the controller 204 increases the amplitude of the power signal to a defined level (e.g., 50% of the nominal level). In response to the cumulative use reaching a second threshold (e.g., 200 hours), the controller 204 further increases the amplitude of the power signal to a defined level (e.g., 75% of the nominal level). In response to the cumulative use reaching a third threshold (e.g., 400 hours), the controller 204 further increases the amplitude of the power signal to a defined level (e.g., 100% of the nominal level). In response to the cumulative use reaching a third threshold (e.g., 1000 hours), the controller 204 further increases the amplitude of the power signal to a defined level (e.g., 150% of the nominal level). Accordingly, the controller 204 incrementally increases the amplitude of the power signal provided to the electroluminescent panel 202 along line 302 to at least partially compensate for decay over time in the luminosity of the electroluminescent panel 202.

The number and size of the incremental amounts that the controller 204 increases the power signal amplitude and/or the number of cumulative utilization time thresholds which trigger increase of the power signal amplitude may be defined based on the expected characteristic decay in luminosity of the electroluminescent panel 202 over its operational lifetime. The characteristic decay may be determined based on testing of exemplary electroluminescent panels, such as the luminosity decay characteristics illustrated in FIG. 1, and may be determined from manufacturer data sheets.

The controller 204 may alternatively or additionally more continuously increase the power signal amplitude as the cumulative utilization time of electroluminescent panel 202 increases. For example, the controller 204 may increase the power signal amplitude along line 304 to at least partially compensate for decay over time in the luminosity of the electroluminescent panel 202. The controller 204 may regulate the power signal amplitude along other line shapes, such as along exponential or polynomial curves which may be defined based on the expected characteristics of the decay in luminosity of the electroluminescent panel 202 during its operational lifetime.

The controller 204 may alternatively or additionally regulate the frequency of the power signal supplied by the power source 206 to the electroluminescent panel 202 in response to the cumulative use of the electroluminescent panel 202 reaching one or more threshold values, such as the four threshold values shown in FIG. 3. Accordingly, the lines 302 and/or 304 shown in FIG. 3 may alternatively/additionally represent incremental/continuous increases to the frequency of the power signal supplied to the electroluminescent panel 202.

The controller 204 may alternatively or additionally track the temperature of the electroluminescent panel 202 over time, and regulate the amplitude and/or frequency of the power signal supplied by the power source 206 to the electroluminescent panel 202 in response to such tracked temperature. For example, the controller 204 may integrate sensed temperature values over defined time periods, and may regulate the amplitude/frequency of the power signal supplied to the panel 202 in response to the integrated temperature values. Accordingly, the lines 302 and/or 304 shown in FIG. 3 may alternatively/additionally represent incremental/continuous increases to the amplitude/frequency of the power signal supplied to the electroluminescent panel 202 in response various integrated temperature value thresholds along the x-axis. In this manner, the controller 204 may compensate for cumulative effects of temperature on decay in luminosity from the electroluminescent panel 202.

Figure 4:
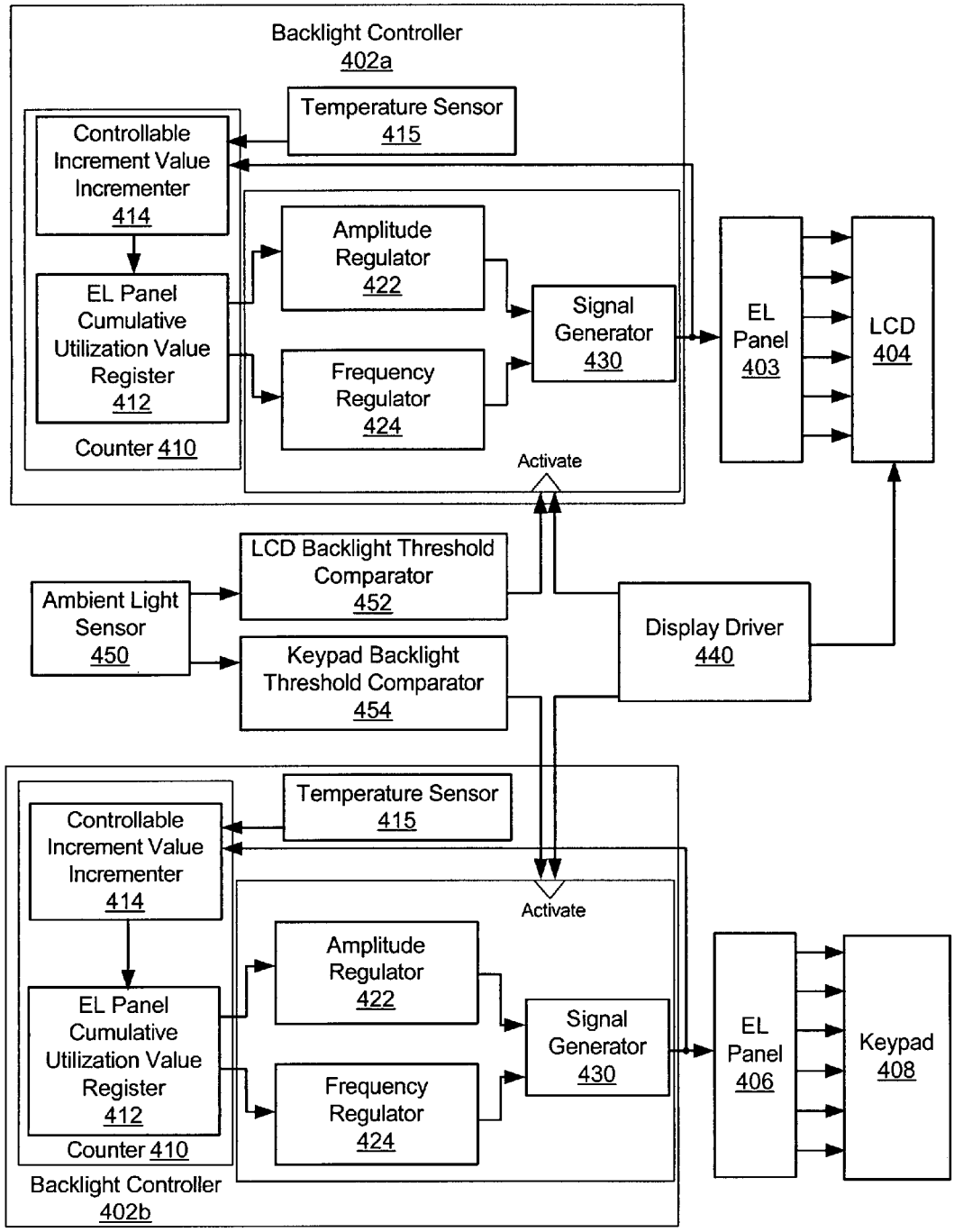
FIG. 4 is a block diagram of controllers and methods that regulate operation of an electroluminescent panel that backlights a liquid crystal display (LCD) and another electroluminescent panel that backlights a keypad, in response to cumulative utilization of the panels, in response to an ambient light, and in response to input from a display driver according to some embodiments of the present invention.

FIG. 4 is a block diagram of a panel controller 402*a* that regulates operation of an electroluminescent panel 403 that backlights a LCD 404, and another panel controller 402*b* that regulates operation of another electroluminescent panel 406 that backlights a keypad 408, in response to, among other things, cumulative utilization of the panels 406/408, in response to ambient light, and in response to input from a display driver 440.

Referring to FIG. 4, the panel controller 402*a* may include a counter 410, an amplitude regulator 422, and a frequency regulator 424. The counter 410 generates a utilization value based on a cumulative time that the electroluminescent panel 420 has emitting light (e.g., total powered-on time since manufacture). The counter 410 may include a register 412 in which the cumulative utilization value for the electroluminescent panel 403 is stored, and an incrementer 414. The incrementer 414 repetitively (e.g. periodically) increments the cumulative utilization value in the register 412 by an incremental amount, which may be varied in response to various operational characteristics of the electroluminescent panel 403, while the electroluminescent panel 403 is backlighting the LCD 404. Accordingly, the cumulative utilization value in register 412 provides an indication of the cumulative time for which the electroluminescent panel 403 has backlit the LCD 404 and, thereby, an indication of the decay in luminosity experienced by the electroluminescent panel 403.

The rate of decay in luminosity from the electroluminescent panel 403 can depend upon the amplitude and/or frequency of the power signal provided by the signal generator 430 thereto. For example, increased power signal amplitude and/or frequency may temporarily increase the luminosity from the electroluminescent panel 403, but may also cause a more rapid decay in the luminosity that can thereafter be obtained at that power signal amplitude and/or frequency. Such effect of power signal amplitude and/or frequency on the rate of luminosity decay may be at least partially reflected in the cumulative utilization value in register 412 by regulating the incremental amount, which the incrementer 414 increments the cumulative utilization value (register 412), in response to the amplitude and/or frequency of the power signal provided by the signal generator 432 to the electroluminescent panel 403.

For example, the incrementer 414 may increase the incremental amount by which it increments the cumulative utilization value in register 412 in response to increased power signal amplitude, and may decrease the incremental amount by which it increments the cumulative utilization value in register 412 in response to decreased power signal amplitude. The luminosity level of the electroluminescent panel 403 may be controlled by a user via control inputs to a display driver 440 (e.g., user commanding increased/decreased backlighting luminosity levels). The cumulative utilization value in register 412 may thereby account for not only the cumulative time that the electroluminescent panel 403 has backlit LCD 404, but may also at least partially account for variation in the rate of luminosity decay experienced by the electroluminescent panel 403 during its operation.

The amplitude regulator 422 controls the amplitude of the power signal, which is provided by a signal generator 430 to the electroluminescent panel 403, in response to the cumulative utilization value in the register 412. The frequency regulator 424 controls the frequency of the power signal provided to the electroluminescent panel 403 in response to the cumulative utilization value in the register 412. Accordingly, the panel controller 402*a* can regulate amplitude and/or frequency of the power signal provided to the electroluminescent panel 403 in response to the cumulative utilization of the electroluminescent panel 403, including based on the cumulative time it has been used as a backlight and based on other operational characteristics (e.g., user commanded luminosity variations) of the electroluminescent panel 403.

A temperature sensor 415 may be provided that generates a temperature signal that is indicative of temperature of the electroluminescent panel 403. The incrementer 414 may vary the incremental value by which it increments the cumulative utilization value in register 412 in response to the sensed temperature. For example, the incremental value may be increased for sensed temperatures higher than one or more threshold values. The utilization value may thereby reflect an integration over time of the sensed temperature of the electroluminescent panel 403. In this manner, the amplitude and/or frequency of the power signal provided to electroluminescent panel 403 may be regulated to compensate for the cumulative effects of temperature on the decay in luminosity from the electroluminescent panel 403.

The panel controller 402*b* may include the same or similar components operating in the same or similar manner to those described herein for the panel controller 402*a* and, accordingly, the description of the same numbered components will not be repeated herein for brevity.

The electroluminescent panels 403 and 406 may be selectively activated to provide backlighting in response to ambient light levels. An ambient light sensor 450 may sense ambient light incident to the electronic device and generate an ambient light signal therefrom. A comparator 452 may activate the panel controller 402*a* to provide backlighting to the LCD 404 when the ambient light signal is less than a LCD backlight threshold value. Similarly, a comparator 454 may activate the panel controller 402*b* to provide backlighting to the keypad 408 when the ambient light signal is less than a keypad backlight threshold value. As explained above, the incrementer 414 in the respective power controllers 402*a-b* is triggered to repetitively increment the cumulative utilization value in register 412 while the corresponding electroluminescent panels 403 and 406 are active. Accordingly, different ambient light thresholds may be defined for separately activating backlighting for the LCD 404 and for the keypad 408, and the corresponding cumulative utilization of each of the electroluminescent panels 403 and 406 may be separately tracked and used to at least partially compensate for luminosity decay thereof.

Although FIG. 4 illustrates exemplary power controllers and signal generators, it will be understood that the present invention is not limited to such configurations, but is intended to encompass any configuration capable of carrying out the operations described herein.

Figure 5:
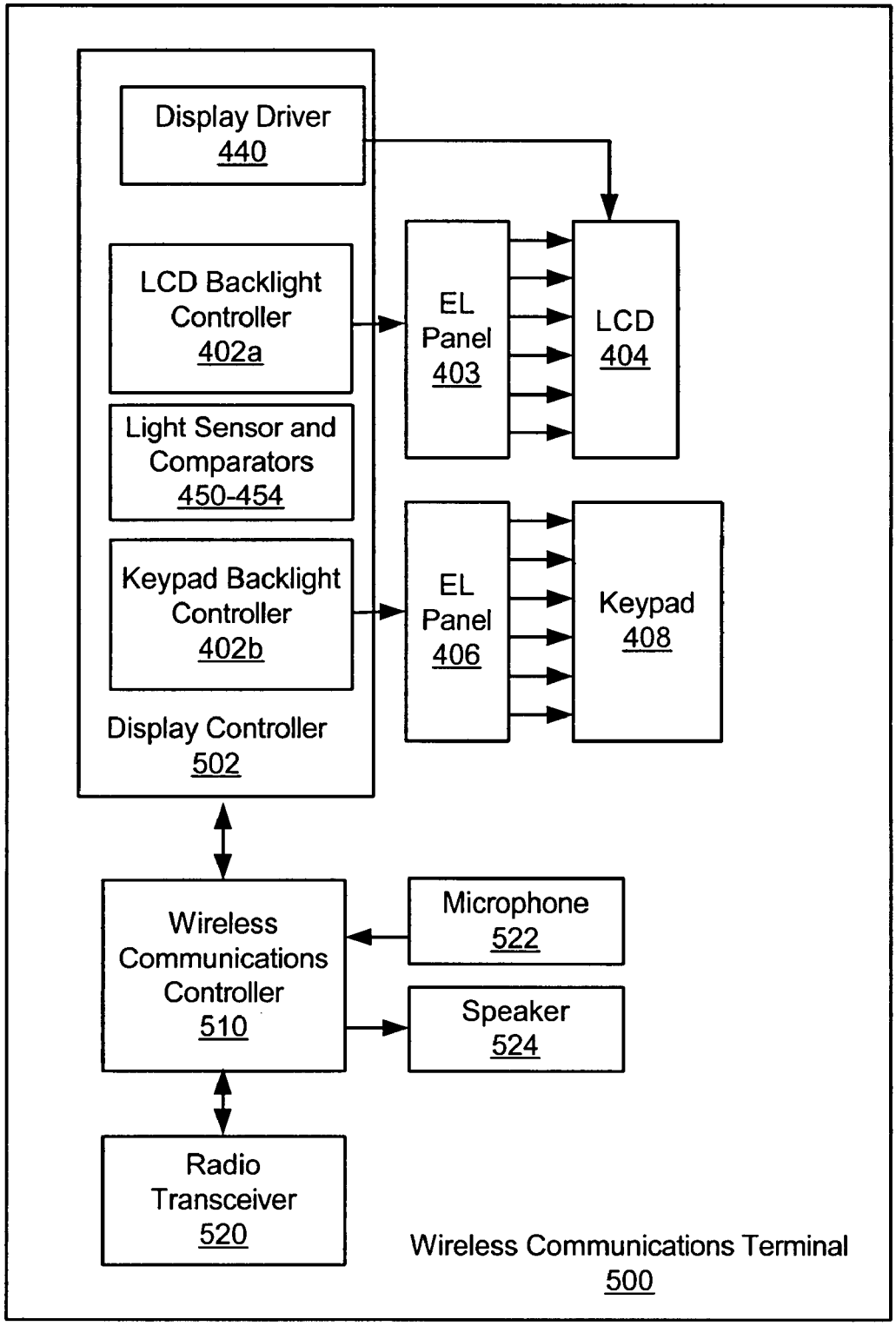
FIG. 5 is a block diagram of a wireless communications terminal that includes a display controller that, in accordance with some embodiments of the present invention, regulates operation of two electroluminescent panels which backlight a LCD and a keypad.

FIG. 5 is a block diagram of a wireless communications terminal 500 that includes a display controller 502 that, in accordance with some embodiments of the present invention, regulates operation of the electroluminescent panels 403 and 406 which respectively backlight the LCD 404 and the keypad 408. The display controller 502 may be configured as shown in FIG. 4 and, accordingly, may include the LCD backlight controller 402*a* and the keypad backlight controller 402*b*, which respectively regulate the amplitude and/or frequency of the power signal provided to the electroluminescent panels 403 and 406, and may further include the display driver 440 and the ambient light sensor and comparator(s) (450, 452, and 454), which can be configured to operate as described above with regard to FIG. 5.

The wireless communications terminal 500 further includes a wireless communications controller 510 and a radio transceiver 520, and may further include a microphone 522 and a speaker 524. The wireless communications controller 510 may be configured to communicate through the radio transceiver 520 over a wireless air interface with one or more RF transceiver base stations and/or other wireless communication devices using one or more wireless communication protocols such as, for example, Global Standard for Mobile (GSM) communication, General Packet Radio Service (GPRS), enhanced data rates for GSM evolution (EDGE), Integrated Digital Enhancement Network (iDEN), code division multiple access (CDMA), wideband-CDMA, CDMA2000, Universal Mobile Telecommunications System (UMTS), WiMAX, and/or HIPERMAN, wireless local area network (e.g., 802.11) and/or Bluetooth.

Figures 6A, 6B, 6C:
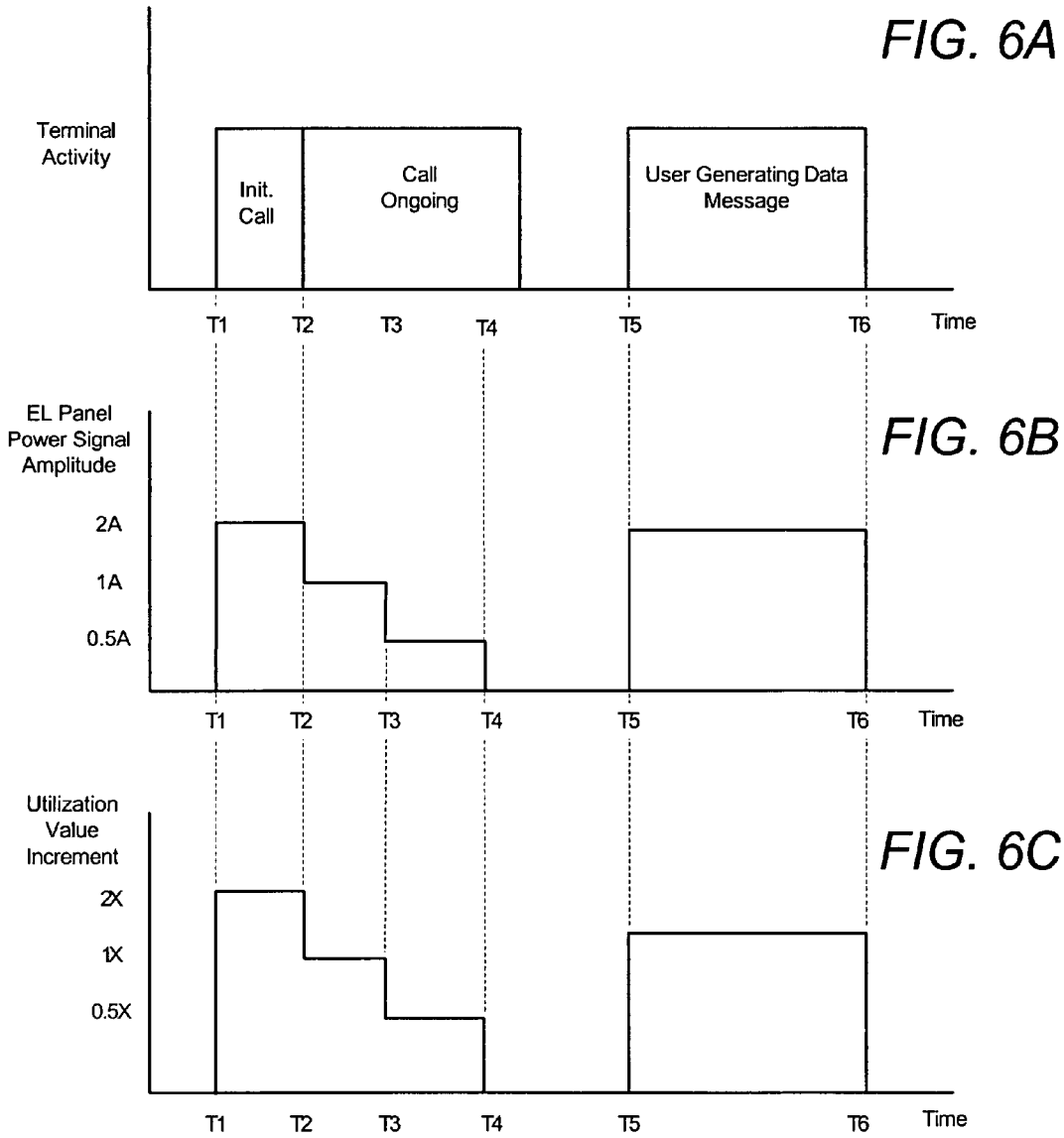
FIGS. 6A-C are graphs that illustrate various operations and methods for regulating the amplitude of a power signal provided to the electroluminescent panels of FIG. 5 according to some embodiments of the present invention.

The wireless communications controller 510 may be configured to carry out wireless communications functionality, such as conventional cellular phone functionality including, but not limited to, voice/video telephone calls and/or data messaging such as text/picture/video messaging. As explained above, the user may change the backlighting luminosity levels of the electroluminescent panels 403 and/or 406 via the keypad 408 and the display driver 440. Moreover, the background luminosity levels of the electroluminescent panels 403 and/or 406 may be regulated in response to operational modes that are being carried out by the wireless communications controller 510. FIGS. 6A-C are exemplary graphs that illustrate various operational modes that may be carried out by the wireless communications controller 510 and resulting regulation of the amplitude of the power signals provided to the electroluminescent panels 403 and 406.

Referring to FIGS. 6A-C, at time T1, a user initiates a call ("Init. Call"), via the wireless communications controller 510, which causes the LCD backlight controller 402*a* and the keypad backlight controller 402*b* to temporarily increase the background illumination levels of the electroluminescent panels 403 and 406 to level 2A ("A" referring to a reference level), which may enable a user to more easily view indicia displayed on the LCD 404 and individual keys of the keypad 408. Upon establishing the call at time T2, the LCD and keypad backlight controllers 402*a-b* decrease the background illumination levels of the electroluminescent panels 403 and 406 to level 1A. At time T3, after a threshold elapsed time into the call, the LCD and keypad backlight controllers 402*a-b* further decrease the background illumination levels of the electroluminescent panels 403 and 406 to level 0.5A.

To account for not only the cumulative time that the electroluminescent panels 403 and 406 are backlight, but also to at least partially account for variation in the rate of luminosity decay experienced by the electroluminescent panel 403 and 406 due to the variation in power signal amplitude, the incremental values by which the incrementers 414 repetitively increment the cumulative utilization values in registers 412 is set to 2X ("X" referring to a reference incremental value) for timeframe T1-T2, reduced to 1X for timeframe T2-T3, and further reduced to 0.5X for timeframe T3-T4.

At time T4, the backlighting is turned off, so the incremental value of the incrementers 414 is reduced to zero (or the incrementers are disabled) so that the cumulative utilization values in registers 412 do not change.

During timeframe T5-T6, a user generates a data message, which causes the LCD and keypad backlight controllers 402*a-b* to temporarily increase the background illumination levels of the electroluminescent panels 403 and 406 to level 2A and, corresponding cause the incremental values by which the incrementers 414 repetitively increment the cumulative utilization values in registers 412 to be set to 2× during timeframe T5-T6. Accordingly, the backlight levels are temporarily increased to enable a user to more easily view indicia displayed on the LCD 404 and individual keys of the keypad 408, and the cumulative utilization values for the electroluminescent panels 403 and 406 are changed to account for not only the cumulative time that the electroluminescent panels 403 and 406 are backlight, but also to at least partially account for variation in the rate of luminosity decay experienced by the electroluminescent panel 403 and 406 due to the variation in power signal amplitude.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. An electronic device comprising:

an electroluminescent panel that generates light in response to a power signal; and a controller that is configured to generate a utilization value based on a cumulative time that the electroluminescent panel has emitting light, to regulate the power signal provided to the electroluminescent panel in response to the utilization value to at least partially compensate for decay in luminosity of the electroluminescent panel over time, and to repetitively increase amplitude of the power signal provided to the electroluminescent panel by one or more defined incremental amounts in response to the utilization value indicating the cumulative time that the electroluminescent panel has emitting light exceeds a sequence of increasing threshold values.

2. The electronic device of claim 1, wherein the controller is further configured to monitor amplitude of the power signal provided to the electroluminescent panel over periods of time, and to regulate the incremental amount by which it repetitively increases the amplitude of the power signal in response to the amplitude of the power signal provided to the electroluminescent panel.

3. The electronic device of claim 1, further comprising an ambient light sensor that generates an ambient light signal, and wherein the controller is further configured to turn-off the light source and, correspondingly, stop increasing the utilization value when the ambient light signal exceeds a threshold value.

4. An electronic device comprising:

an electroluminescent panel that generates light in response to a power signal; and a controller that is configured to generate a utilization value based on a cumulative time that the electroluminescent panel has emitting light, to regulate the power signal provided to the electroluminescent panel in response to the utilization value to at least partially compensate for decay in luminosity of the electroluminescent panel over time, and to vary frequency of the power signal provided to the electroluminescent panel to increase luminosity therefrom based on an increased utilization value indicating an increased cumulative time that the electroluminescent panel has emitting light.

5. An electronic device comprising:

a light source that generates light in response to a signal;

a controller that is configured to generate a utilization value based on a cumulative time that the light source has emitting light, and to regulate the signal provided to the light source in response to the utilization value to at least partially compensate for decay in luminosity of the light source over time; and a temperature sensor that is configure to generate a temperature signal that is indicative of temperature of the light source, wherein the controller is further configured to generate the utilization time based on integration of the temperature signal over time, and to regulate the signal provided to the light source in response to the utilization value to at least partially compensate for decay in the luminosity of the light source due to effects of temperature over time.

6. The electronic device of claim 5, wherein:

the light source comprises an electroluminescent panel that generates light in response to a power signal; and the controller is further configured to regulate amplitude and/or frequency of the power signal provided to the light source in response to the utilization value to at least partially compensate for decay in the luminosity of the light source due to effects of temperature over time.

7. The electronic device of claim 5, further comprising a liquid crystal display (LCD), and wherein:

the light source comprises an electroluminescent panel that generates light in response to a power signal, the electroluminescent panel being configured as a backlight to the LCD; and the controller is configured to display indicia on the LCD, to generate the utilization value based on the cumulative time that the electroluminescent panel has backlit the LCD, and to regulate the power signal provided to the electroluminescent panel in response to the utilization value to at least partially compensate for decay in luminosity of the electroluminescent panel over time.

8. An electronic device comprising:

a light source that generates light in response to a signal;

a controller that is configured to generate a utilization value based on a cumulative time that the light source has emitting light, and to regulate the signal provided to the light source in response to the utilization value to at least partially compensate for decay in luminosity of the light source over time; and a keypad, and wherein:

the light source comprises an electroluminescent panel that generates light in response to a power signal, the electroluminescent panel being configured as a backlight to the keypad; and the controller is configured to initiate a cellular phone call and/or generate a data message in response to user actuation of the keypad, to generate the utilization value based on the cumulative time that the electroluminescent panel has backlit the keypad, and to regulate the power signal provided to the electroluminescent panel in response to the utilization value to at least partially compensate for decay in the luminosity of the electroluminescent panel over time.

9. A method comprising:

generating a utilization value based on a cumulative time that an electroluminescent panel has emitting light; and regulating a power signal, which is provided to the electroluminescent panel to generate light, in response to the utilization value to at least partially compensate for decay in luminosity of the light source; and repetitively increasing amplitude of the power signal provided to the electroluminescent panel by one or more defined incremental amounts in response to the utilization value indicating the cumulative time that the electroluminescent panel has emitting light exceeds a sequence of increasing threshold values.

10. The method of claim 9, further comprising varying frequency of the power signal provided to the electroluminescent panel to increase luminosity therefrom based on an increased utilization value indicating an increased cumulative time that the electroluminescent panel has emitting light.

11. The method of claim 9, further comprising:

monitoring amplitude of the power signal provided to the light source over periods of time; and regulating the incremental amount by which it repetitively increases the amplitude of the power signal in response to the amplitude of the power signal provided to the light source.

12. The method of claim 9 further comprising:

monitoring amplitude of the signal provided to the light source; and generating the utilization value in response to the cumulative time that the light source has emitted light and the associated amplitude of the signal.

* * * * *